US007350374B1

(12) United States Patent
Tashlitsky

(10) Patent No.: US 7,350,374 B1
(45) Date of Patent: Apr. 1, 2008

(54) CONSUMER REFRIGERATOR

(76) Inventor: Marlen Tashlitsky, 3319 Kings Hwy., #4L, Brooklyn, NY (US) 11234

( * ) Notice: Subject to any disclaimer, the term of this patent is extended or adjusted under 35 U.S.C. 154(b) by 0 days.

(21) Appl. No.: 11/708,387

(22) Filed: Feb. 20, 2007

(51) Int. Cl.
*F25D 11/02* (2006.01)

(52) U.S. Cl. ..... 62/441; 312/407

(58) Field of Classification Search ..... 62/441–447; 312/407
See application file for complete search history.

(56) References Cited

U.S. PATENT DOCUMENTS 3,478,536 A * 11/1969 Kohya et al. ..... 62/441
4,586,347 A 5/1986 McCarty
5,375,432 A * 12/1994 Cur ..... 62/320
5,551,252 A * 9/1996 Lee ..... 62/441
6,314,746 B2 * 11/2001 Ohya et al. ..... 62/187
6,318,099 B1 11/2001 Hwang
6,412,286 B1 * 7/2002 Park et al. ..... 62/3.6
6,637,235 B2 * 10/2003 Sakamoto et al. ..... 62/443
7,032,408 B2 4/2006 Dentella
7,185,507 B2 * 3/2007 Maglinger et al. ..... 62/344
7,281,391 B2 * 10/2007 Marret et al. ..... 62/389

* cited by examiner

*Primary Examiner*—William E Tapolcai
(74) *Attorney, Agent, or Firm*—Aleksandr Smushkovich

(57) ABSTRACT

A proposed refrigerator embodiment comprises a body enclosing a lower fresh-food compartment at above-freezing temperatures; a freezer disposed above the lower compartment, an intermediate-temperature compartment disposed above the freezer both operating at below-freezing temperatures. The freezer is separated from the intermediate-temperature compartment by its top wall, from the lower compartment by its bottom wall, and from the body's walls by its sidewalls and rear wall with a gap therebetween. The freezer's walls have predetermined thickness and heat conductivity, for passing certain cold flows through, thereby arranging predetermined temperatures in the compartments. The gap around the freezer's top wall is filled by sealing means, preventing warmer airflows from the lower container into the intermediate-temperature compartment. A rigid net, rested on supporting means fixed to the body, supports the freezer. Another net can be mounted above the freezer to support items in the intermediate-temperature compartment. A screen sheets embodiment is also disclosed.

1 Claim, 1 Drawing Sheet

A-A

CONSUMER REFRIGERATOR

TECHNICAL FIELD

The present invention relates to cooling devices, particularly to consumer refrigerators.

BACKGROUND OF THE INVENTION

Prior art describes several types of refrigerators with different cool air distribution structures, for example: U.S. Pat. Nos. 7,032,408, 6,318,099, 6,314,746, 4,586,347, entirely incorporated herein by reference.

The above enumerated and most of other known refrigeration devices include a freezer compartment, substantially immediately communicated with an evaporator and maintaining below-freezing temperatures, and a fresh food (or sometimes called vegetable) compartment, maintaining above-freezing temperatures. It is also well known, that these two compartments often don't satisfy consumers, so that many recent refrigerators include at least one intermediate temperature compartment, (e.g. for storing beverages, etc.), wherein a desirable temperature zone can be created using different cool air passages, ducts and fans, supplying the cool air substantially from the area surrounding the evaporator.

In the other words, the known constructions mostly utilize enforced cool air circulation methods and means to provide necessary temperature ranges in different compartments, which require installation of fans and arrangement of paths (air-ducts, pipes, etc.) that, in turn, require some physical space, and additional power for the fans. Therefore, the internal space of the refrigerators is underused. Moreover, losses of cold often take place because the cold flows leak through the top or bottom walls of the freezer compartment, since they are frequently positioned at the top or at the bottom of the main body of refrigerator, and through the freezer compartment's sidewalls since they constitute portions of the main body's sidewalls.

BRIEF SUMMARY OF THE INVENTION

The invented refrigeration device is proposed to solve the above-mentioned problems.

A proposed refrigerator embodiment comprises a body enclosing a lower fresh-food container at above-freezing temperatures; a freezer disposed above the lower container, an intermediate-temperature compartment disposed above the freezer both operating at below-freezing temperatures. The freezer is separated from the intermediate-temperature compartment by its top wall, from the lower compartment by its bottom wall, and from the body's walls by its sidewalls and rear wall with a gap therebetween. The freezer's walls have predetermined thickness and heat conductivity, for passing certain cold flows through, thereby arranging predetermined temperatures in the compartments. The gap around the freezer's top wall is filled by sealing means, preventing warmer airflows from the lower compartment into the intermediate-temperature compartment. A rigid net, rested on supporting means fixed to the body, supports the freezer. Another net can be mounted above the freezer to support items in the intermediate-temperature compartment. A screen sheets embodiment is also disclosed.

BRIEF DESCRIPTION OF DRAWINGS

Similar reference numerals on the drawings generally refer to the same or similar elements on both figures. A newly introduced numeral in the description is enclosed into parentheses.

A PREFERRED EMBODIMENT OF THE PRESENT INVENTION

Figure 1:
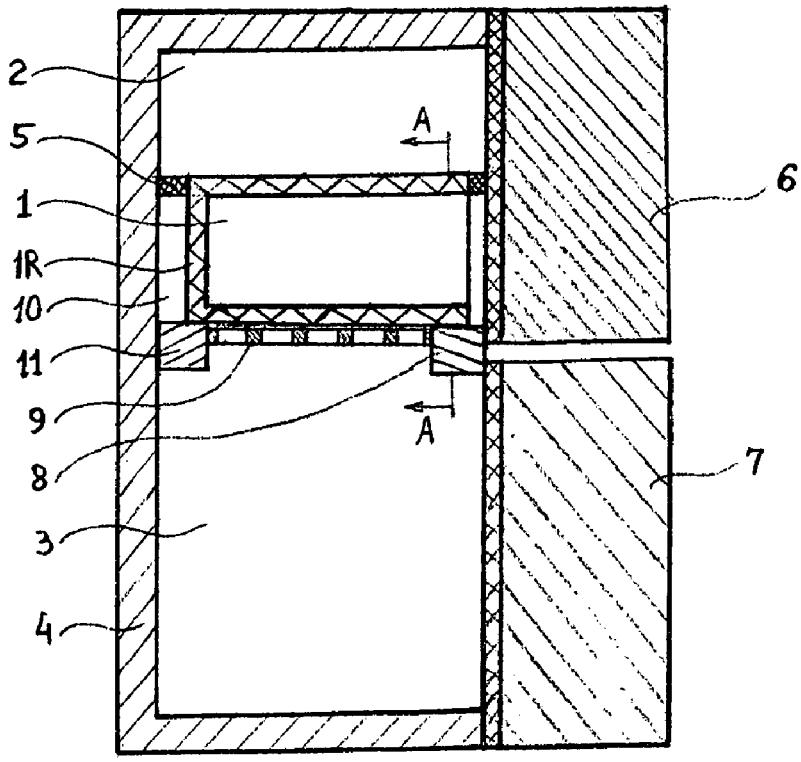
FIG. 1 illustrates a side sectional view of the inventive refrigerator, according to an embodiment of the present invention.

While the invention may be susceptible to embodiment in different forms, there is shown in the drawings, and will be described in detail herein, a specific embodiment of the present invention, with the understanding that the present disclosure is to be considered an exemplification of the principles of the invention, and is not intended to limit the invention to that as illustrated and described herein.

According an embodiment of the invented refrigerator illustrated on FIG. 1, it comprises a main body (4) (or cabinet) divided into three sections: a lower compartment (3), a freezer compartment (1) disposed substantially immediately above the lower compartment 3, and an intermediate-temperature compartment (2) disposed above the freezer compartment 1. The lower compartment 3 is preferably arranged for storing fresh food at above-freezing temperatures. The freezer compartment 1 and the intermediate-temperature compartment 2 are arranged for substantially below-freezing temperatures, wherein the temperature in the compartment 2 is higher than the temperature in the compartment 1.

Figure 2:
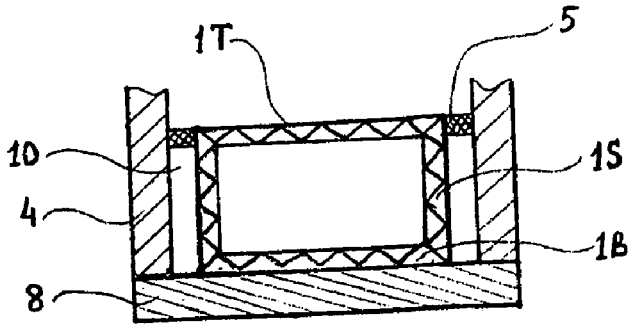
FIG. 2 illustrates a partial sectional view of the embodiment shown on FIG. 1.

The compartment 1 is substantially shaped as a right angle parallelepiped having a plurality of walls: a top wall (1T), two sidewalls (1S), a rear wall (1R), and a bottom wall (1B) illustrated on FIGS. 1, 2. In preferred embodiments, a conventional evaporator is built in at least some of these walls.

The top of the intermediate-temperature compartment 2 is substantially the top wall of the main body 4 of refrigerator. Preferably, the heights of the compartments 1 and 2 are substantially equal. In preferred embodiments, the compartment 1 and the compartment 2 have a common door (6); and the compartment 3 has a door (7), as shown on FIG. 1. In some embodiments the compartment 1 and the compartment 2 can be furnished with their own internal doors (not illustrated), installed behind the door 6.

The compartment 2 occupies the whole volume of the top portion of the body 4. The compartment 1 is performed narrower than the corresponding internal portion of the body 4, within which it is situated, so that there are surrounding space volumes (10) between the rear wall 1R and the rear wall of the body 4, as well as between the sidewalls 1S and the sidewalls of the body 4, as shown on FIGS. 1, 2.

In some embodiments (not illustrated) the space volumes 10 can be utilized as additional (lateral) compartments for storage of items requiring a temperature slightly higher than the below-freezing temperature in the compartment 1 (like, for example, the new temperature zone of freezer compartment 300 in U.S. Pat. No. 6,314,746).

The compartments 1 and 2 are separated by the top wall 1T of the compartment 1 with a predetermined thickness and heat conductivity, particularly to supply a predetermined cold flow through the top wall 1T into the compartment 2 at the time of operation of the evaporator. Appropriate sealing means (5) are peripherally installed around the top wall 1T to fill the gap between the perimeter of the top wall 1T and the rear wall and sidewalls of the body 4, so that preventing the upward penetration of convectional warmer air from the compartment 3 substantially into the compartment 2 through the volumes 10, as depicted on FIGS. 1, 2.

The compartment 1 is separated from the compartment 3 by the bottom wall 1B, and substantially (via the space volumes 10) by the sidewalls 1S and rear wall 1R of the compartment 1. Each of these walls has a predetermined thickness and heat conductivity, so that predetermined cold flows can be passed through the corresponding walls during operation of the evaporator.

Optionally, a rigid upper net can be fixedly mounted to the sidewalls of the body 4 above the top wall 1T (not shown), if it's needed for support of items stored in the compartment 2.

The inventive refrigerator comprises a front bar (8) and preferably two back corner supports (11) mounted immediately below the bottom wall 1B, at a level dividing the compartment 3 and the compartment 1. The bar 8 and the supports 11 are secured preferably to the sidewalls of the body 4. The upper surfaces of the bar 8 and the supports 11 are situated substantially in the same level. In some embodiments the supports 11 and bar 8 can be made solid, in other they can be hollowed to contain other means (e.g. defrosting, etc.), or they may have another suitable profile. The supports 11 may be made in the form of appropriate brackets, and optionally can be fixed to the rear wall of the body 4, or to both: the sidewalls and the rear wall of the body 4.

The preferred embodiment of the inventive refrigerator comprises a predeterminedly rigid lower supporting net (9), mounted upon the supports 11 and upon the front bar 8. The bottom wall 1B is rested upon the net 9.

The above disclosed structure permits saving cold energy by reducing losses via the top, the bottom, the rear walls, and the sidewalls of the freezer compartment during operation of the evaporator, and utilizing more internal space for useful food storage by eliminating fans and passages.

ADDITIONAL EMBODIMENTS OF THE PRESENT INVENTION

In some embodiments a rigid net shelf (not shown) can be arranged above the top wall 1T, serving only for support of items contained in the intermediate-temperature compartment 2.

In special embodiments (not illustrated) the freezer's walls may be arranged to have fastening means (brackets, springed elements, magnets, double-adhesive strips, Velcro™ strips, snaps, and the like) on the outer surface of the compartment 1, which fastening means may serve for attachment of substantially planar screen sheets (not shown) with predetermined thickness and heat conductivity. By attaching a number of such screen sheets, it is possible to reduce the cold flow in the direction where the sheets are installed. The reduction of cold flow in a particular direction would be depending on the number of sheets attached to the side of the direction, and upon the thickness and heat conductivity of each screen sheet.

Thus, the attaching or removing the screen sheets would enable to change (or redistribute) the temperature in the lower, upper, and lateral compartments, surrounding the freezer, in a desirable manner. It can be done either manually, or by implementing simple mechanisms (not shown), including those that allow manipulating the screen sheets from outside of the refrigerator body. The screens can also be made foldable, or comprise multiple pieces shiftable relatively to each other.

The design principles disclosed above may also be applied to cooling devices, other than consumer refrigerators. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A refrigerator comprising:

a main body including sidewalls and a rear wall;

a lower compartment for storing items at temperatures substantially above the freezing temperature, said lower compartment arranged in the lower region of the main body;

a freezer compartment for storing items in a first temperature range substantially below the freezing temperature, said freezer compartment disposed substantially above said lower compartment, said freezer compartment including a top wall, a bottom wall, a rear wall, and sidewalls, so configured that the sidewalls and the rear wall of the freezer compartment separated respectively from said sidewalls and said rear wall of the main body by a gap;

an intermediate temperature compartment for storing items in a second temperature range substantially below the freezing temperature, said intermediate temperature compartment disposed substantially above the freezer compartment;

sealing means peripherally installed around the top wall to fill the gap between the perimeter of the top wall and the sidewalls and the rear wall of the main body;

supporting means attached to the main body substantially at a level dividing the freezer compartment and the lower compartment, said freezer compartment supported by the supporting means; wherein the intermediate temperature compartment separated from the freezer compartment by the top wall of the freezer compartment; the lower compartment separated from the freezer compartment by the bottom wall and substantially by the sidewalls and the rear wall of the freezer compartment, and said top wall, bottom wall, rear wall and sidewalls of the freezer compartment each having a predetermined thickness and heat conductivity to allow passing predetermined cold flows through these walls.

* * * * *